US008970642B2

(12) United States Patent
An et al.

(10) Patent No.: US 8,970,642 B2
(45) Date of Patent: Mar. 3, 2015

(54) DISPLAY DEVICE AND DRIVING METHOD THEREOF

(75) Inventors: Bo-Young An, Yongin (KR); Ho-Suk Maeng, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 203 days.

(21) Appl. No.: 13/439,673

(22) Filed: Apr. 4, 2012

(65) Prior Publication Data

US 2013/0127923 A1 May 23, 2013

(30) Foreign Application Priority Data

Nov. 18, 2011 (KR) ..... 10-2011-0120912

(51) Int. Cl.
*G09G 5/10* (2006.01)

(52) U.S. Cl.
CPC ..... *G09G 5/10* (2013.01)
USPC ..... 345/690; 345/77; 345/78; 345/82; 345/83

(58) Field of Classification Search
USPC ..... 313/463; 315/169.3; 345/76–77, 82–83, 345/204, 690–691, 694–696
See application file for complete search history.

(56) References Cited

U.S. PATENT DOCUMENTS 7,176,879 B1 * 2/2007 Yoshihara et al. ..... 345/102
7,688,292 B2 * 3/2010 Park et al. ..... 345/82
2005/0225548 A1 10/2005 Han et al.
2007/0182756 A1 8/2007 Brown Elliott et al.
2008/0150844 A1 * 6/2008 Choi ..... 345/76
2008/0198183 A1 * 8/2008 Min et al. ..... 345/691
2009/0027312 A1 * 1/2009 Han et al. ..... 345/76
2009/0040151 A1 * 2/2009 Lee ..... 345/77
2009/0195484 A1 * 8/2009 Lee et al. ..... 345/76
2010/0328369 A1 * 12/2010 Shingai ..... 345/690
2011/0216097 A1 * 9/2011 Yoo et al. ..... 345/690
2012/0019506 A1 * 1/2012 Hekstra et al. ..... 345/212

FOREIGN PATENT DOCUMENTS

KR 10-0836423 B1 2/2008
KR 10-2010-0103361 A 9/2010
KR 10-2011-0012990 A 2/2011

* cited by examiner

*Primary Examiner* — Lun-Yi Lao
*Assistant Examiner* — Elliott Deadrick
(74) *Attorney, Agent, or Firm* — Knobbe, Martens, Olson & Bear, LLP

(57) ABSTRACT

In one aspect, the display device includes a display unit including a plurality of pixels connected to scan lines, light emission control lines, and data lines, where each pixel is configured to emit light with a driving current corresponding to image data signals transmitted through the data lines based on light emission control signals transmitted through the light emission control lines. Each of the pixels includes subpixels, each configured to display one of a plurality of colors. The device also includes a controller configured to convert external video signals to image data signals, output the converted signals to a data driver, generate light emission driving control signals for controlling the light emission duty ratio of the light emission control signals, and calculate the pixel-on-ratio for each subpixel to reduce the driving current.

26 Claims, 8 Drawing Sheets

DISPLAY DEVICE AND DRIVING METHOD THEREOF

CROSS-REFERENCE TO RELATED APPLICATIONS

This application claims priority to and the benefit of Korean Patent Application No. 10-2011-0120912 filed in the Korean Intellectual Property Office on Nov. 18, 2011, the entire contents of which are incorporated herein by reference.

BACKGROUND

1. Field

The disclosed technology relates to a display device and a driving method thereof, and more particularly, to an organic light emitting diode (OLED) display, to which current consumption reduction technology is applied and a driving method thereof.

2. Description of the Related Technology

A display device has a display area with a plurality of pixels on a substrate in a matrix and has scan lines and data lines connected to each pixel to selectively apply data signals to the pixels, so as to display images. Display devices may, for example, be either a passive matrix light emitting display device or an active matrix light emitting display device depending on the method of driving the pixels. Many display devices are active matrix light emitting display devices in which unit pixels have high resolution, contrast, and operation speed.

Such display devices are used in personal computers, mobile phones, portable information terminals such as PDAs, etc., or in various other information devices. Common types of display technologies include, for example, a liquid crystal display (LCD), an organic light emitting diode (OLED) display, and a plasma panel (PDP). Recently, various light emitting display devices with low weight and volume, as compared to the cathode ray tubes, have been developed. In particular, OLED displays having high luminance efficiency, preferable luminance and viewing angles, and quick response speed are attracting attention.

In the OLED displays, a control method of automatically controlling current (Automatic Current Limit, hereinafter, referred to as 'ACL') to lower luminance on the display when the entire screen is lighted at high luminance by video signals in one frame, is used to reduce power consumption. The aforementioned ACL method includes summing all data values for a frame of data on an organic light emitting display panel to determine an average luminance value of the organic light emitting display panel, adjusting a light emission period depending on the luminance value, or changing the image data to control driving current. However, it is hard to apply the aforementioned ACL method because the data to be summed is different from the data for the data rendering technology which has been variously developed for display devices, or optical characteristics of image quality displayed after data rendering may not be guaranteed. Therefore, it is necessary to develop an improved ACL method to be integrated with the data rendering technology and applicable.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a display device. The device includes a display unit including a plurality of pixels connected to a plurality of scan lines, a plurality of light emission control lines, and a plurality of data lines, where each pixel is configured to emit light with a driving current corresponding to image data signals transmitted through the data lines during a light emission period based on light emission control signals transmitted through the light emission control lines. Each of the pixels includes a plurality of subpixels, each configured to display one of a plurality of colors. The device also includes a controller configured to convert external video signals to image data signals, output the converted signals to a data driver, generate light emission driving control signals for controlling the light emission duty ratio of the light emission control signals, and calculate the pixel-on-ratio for each subpixel to reduce the driving current for displaying images according to the pixel on ratio of the subpixel.

Another inventive aspect is a method of driving a display device, the device including a display unit including a plurality of pixels emitting light with driving current corresponding to image data signals during a light emission period depending on light emission control signals transmitted through a plurality of light emission control lines. The Method includes converting input video signals to first image data signals, calculating the pixel on ratio for each subpixel displaying one of a plurality of colors according to the first image data signals transmitted each frame, and reducing the driving current based on the pixel on ratio of the subpixels.

DETAILED DESCRIPTION OF CERTAIN INVENTIVE EMBODIMENTS

Figure 1:
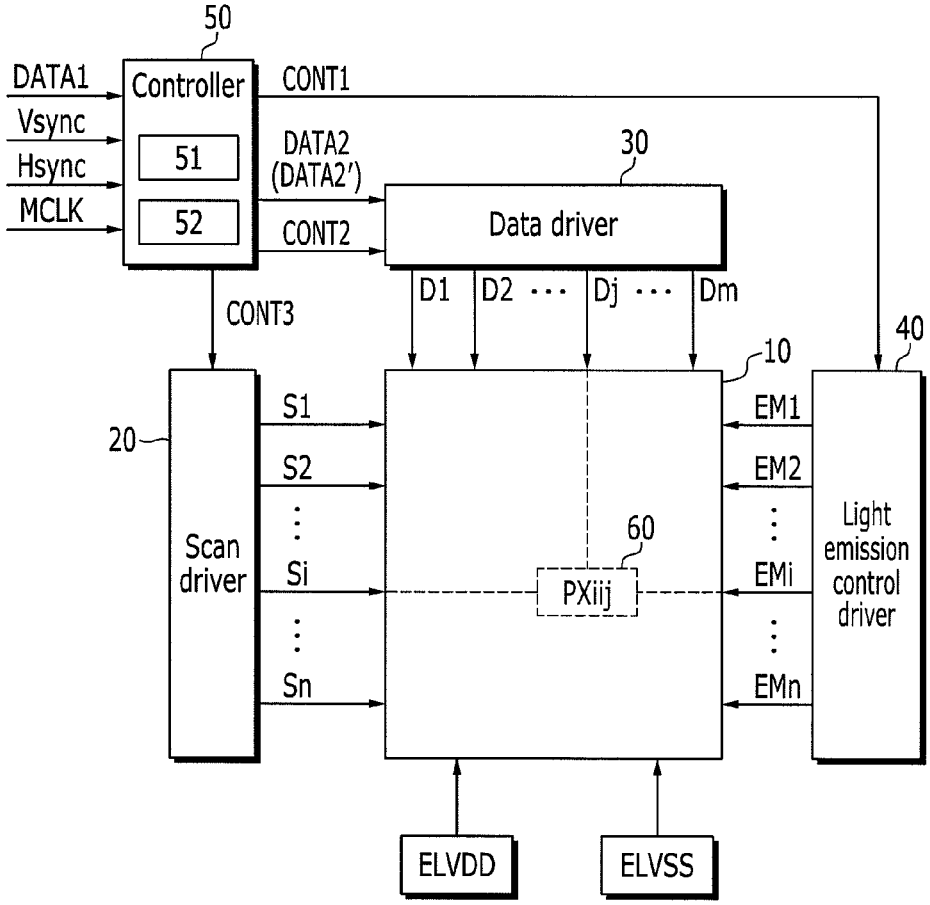
FIG. 1 is a block diagram of a display device according to an exemplary embodiment.

Various aspects are described more fully hereinafter with reference to the accompanying drawings, in which exemplary embodiments are shown. As those skilled in the art would realize, the described embodiments may be modified in various different ways, all without departing from the spirit or scope of the present invention.

Further, in the embodiments, like reference numerals generally designate like elements throughout the specification representatively in a first exemplary embodiment and, in some cases, only elements other than those of the first exemplary embodiment are described. The drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising," will be understood to imply the inclusion of stated elements but not the exclusion of any other elements.

FIG. 1 is a block diagram of a display device according to an exemplary embodiment. Referring to FIG. 1, the display device includes a display unit 10 including a plurality of pixels 60, a scan driver 20, a data driver 30, a light emission control driver 40, a controller 50, and a power supply for supplying a first voltage ELVDD and a second voltage ELVSS.

The display unit 10 includes a plurality of signal lines $S_1$-$S_n$, $D_1$-$D_m$, and $EM_1$-$EM_n$ and a plurality of pixels connected to the plurality of signal lines $S_1$-$S_n$, $D_1$-$D_m$, and $EM_1$-$EM_n$ and arranged in a matrix format. The signal lines $S_1$-$S_n$, $D_1$-$D_m$, and $EM_1$-$EM_n$ include a plurality of scan lines $S_1$-$S_r$, for transmitting scan signals, a plurality of data lines $D_1$-$D_m$ for transmitting data signals, and a plurality of light emission control lines $EM_1$-$EM_n$ for transmitting light emission control signals. The scan lines $S_1$-$S_n$ and the light emission control lines $EM_1$-$EM_n$ extend in a substantial row direction and are substantially parallel to each other, and the data lines $D_1$-$D_m$ extend in a substantially column direction and are substantially parallel to each other.

FIG. 1 illustrates only a pixel (PXiij) 60 formed at the point where the i-th scan line Si, the j-th data line Dj and the i-th light emission control line EMi cross each other. The pixel circuit PXiij includes a light emitting diode (for example, organic light emitting diode (OLED)). The light emitting diode is connected to the power supply for supplying the first voltage ELVDD and the second voltage ELVSS. Specifically, one end and the other end of OLED are electrically connected to the first voltage ELVDD and the second voltage ELVSS, respectively, and the OLED emits light depending on the current flowing between the two terminals. Here, the current flowing between the two terminals of the light emitting diode is referred to as driving current (Ioled).

Each pixel circuit generates and transmits driving current (Ioled) to the OLED depending on the image data signals, the first voltage ELVDD and the second voltage ELVSS, and the OLED emits light at brightness proportional to the driving current (Ioled). Here, the first voltage ELVDD may be a voltage higher than the second voltage ELVSS.

The scan driver 20 generates and transmits a plurality of scan signals to the scan lines $S_1$-$S_n$ depending on the scan driving control signals CONT3 transmitted from the controller 50, respectively. That is, the scan driver 20 applies scan signals to the display unit 10 every specific cycle (for example, horizontal synchronization signal Hsync cycle), which is controlled by the scan driving control signals CONT3. The plurality of scan signals are signals for transmitting signals for activating pixels to one of the plurality of scan lines to transmit the image data signals to the pixel circuit.

The data driver 30 receives a plurality of image data signals DATA2 and DATA2' transmitted from the controller 50, generates and transmits a plurality of image data signals to pixel row by pixel row through the plurality of data lines $D_1$-$D_m$. That is, the data driver 30 applies image data signals DATA2 and DATA2' to the display unit 10 for every specific cycle (for example, vertical synchronization signal Vsync cycle), which is controlled by the data driving control signals CONT2 transmitted from the controller 50.

In this case, the image data signals applied by the data driver 30 may be the image data signal DATA2 primarily converted from an external video signal DATA1, according to the exemplary embodiment of the method of ACL, or the image data signal DATA2' obtained by compensating for the luminance of the primarily converted image data signal DATA2 again.

The light emission control driver 40 generates and transmits a plurality of light emission control signals to the light emission control lines EM1-EMn depending on the light emission driving control signals CONT1 transmitted from the controller 50. That is, the light emission control driver 40 applies light emission control signals to the display unit 10 for every specific cycle (for example, horizontal synchronization signal Hsync cycle), which is controlled by the light emission driving control signals CONT1. The plurality of light emission control signals are used for controlling the light emission duty of pixels on one of the plurality of light emission control lines.

That is, the light emission duty ratio of the plurality of light emission control signals is controlled by the light emission driving control signals CONT1 including off duty width information of the pulse calculated to apply the ACL technology according to the exemplary embodiment.

The controller 50 receives image data signals DATA1, horizontal synchronization signals Hsync, vertical synchronization signals Vsync and main clock signals MCLK which are transmitted from the outside, and outputs image data signals DATA2 and DATA2' converted to correspond to scan driving control signals CONT3, data driving control signals CONT2, light emission driving control signals CONT1 and image data signals DATA1, required for displaying images in the display unit 10 depending on the image data signals DATA1. Here, the image data signals DATA1 include a plurality of grayscale data for controlling luminance of each of the plurality of pixels. The image data signals DATA1 correspond to the color display signals (RGB signals) corresponding to each color when the plurality of pixels included in the display unit 10 are composed of subpixels for displaying basic 3 primary colors R, G, and B, respectively.

If the structure of the plurality of pixels included in the display unit 10 is the PenTile structure in which the ratio of the different number of red, blue and green subpixels is 1:1:2 (RGBG), not an ordinary arrangement scheme of subpixels for displaying primary three colors of red, green and blue, the controller 50 outputs the image data signals DATA2, DATA2' which are the converted version of the image data signals DATA1, that is, RGB signals, to correspond to the PenTile structure.

Meanwhile, the controller 50 may include a data converter 51 and an automatic current limiter 52 in order to apply ACL technology to the PenTile structure of the display device as described above.

The data converter 51 changes the image data signals DATA1 input from the outside to the image data signals DATA2 through the PenTile algorithm in order to apply the image data signals DATA1 to the PenTile structure. This is to convert the image data signals DATA1, that is, RGB signals, to correspond to the PenTile structure. In this case, the image data signals DATA2 are the signals primarily converted through the algorithm (for example, L6 algorithm) of the data converter 51. That is, for example, an image data signal transmitted to the first RGB pixel is converted to be transmitted to the RG1 pixel, and an image data signal transmitted to the second RGB pixel is converted to be transmitted to the BP2 pixel.

According to the ACL technology, the image data signals DATA1 may primarily be converted to be modulated to image data signals DATA2, and may then be subject to the compensation value calculation process of RGB data once again in order to reduce luminance above a predetermined level of reference luminance. The controller 50 may thus output compensated image data signals DATA2'.

The automatic current limiter 52 receives the image data signals DATA2 converted to be applied to the PenTile structure, and calculates the pixel on ratio for each subpixel with the received image data signals. It is not necessary that the automatic current limiter 52 includes a pixel on ratio calculator structure for calculating the pixel on ratio, provided that the controller 50 includes the pixel on ratio calculator structure.

The automatic current limiter 52 applies the power consumption reduction scheme selected for the image data signals DATA2 converted in the data converter 51 according to an exemplary embodiment of a driving method of a display device.

It is possible to convert the image data signals DATA2' compensated by reducing luminance above the predetermined level of reference luminance to correspond to the image data signals converted in the data converter 51 according to the exemplary embodiment. According to another exemplary embodiment, it is possible to calculate an off duty width for light emission control of the light emission control signals by using the image data signals DATA2 converted to be applied to the PenTile structure. That is, the greater the off duty width of the light emission control signals is, the longer the period of time is, in which light emission of each pixel in the display unit 10 is blocked, and the smaller power consumption is. The automatic current limiter 52 may calculate the aforementioned off duty width. The specific configuration and resulting functions of certain embodiments of the controller 50 will be described hereinafter with reference to the drawings.

Referring to FIG. 1, the controller 50 is constructed to include the data converter 51 and the automatic current limiter 52, but the configuration is not limited thereto. Of course, other structures may be further included for generating control signals in order to externally receive video signals, synchronous signals, and clock signals to display images, although not shown in FIG. 1.

Figure 2:
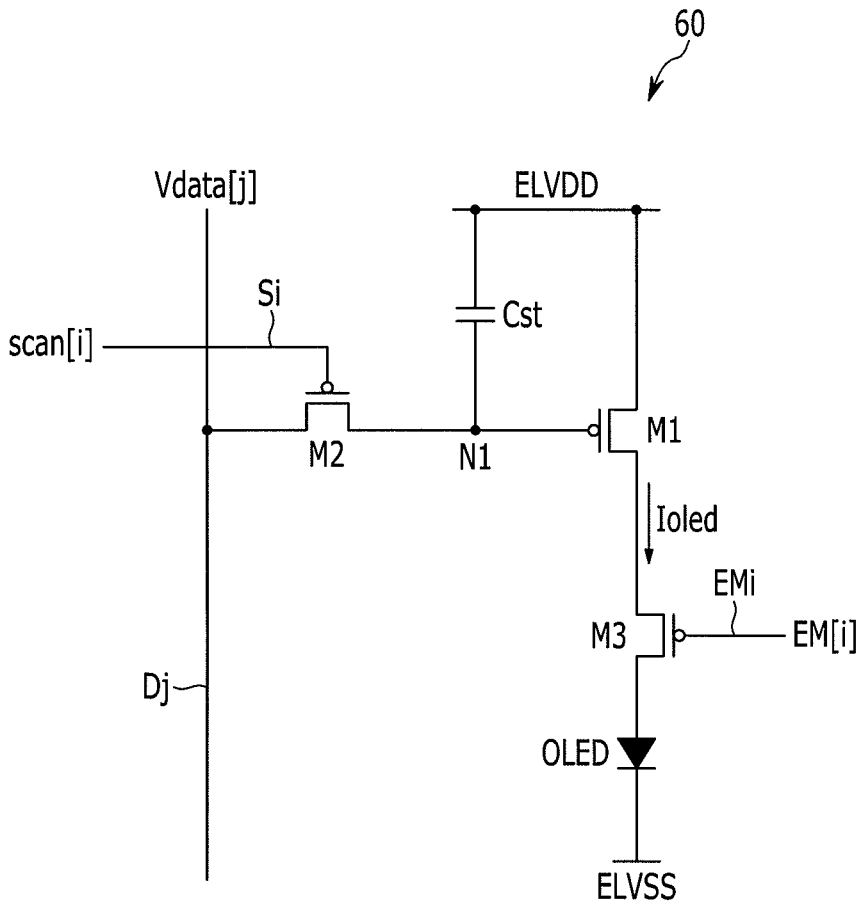
FIG. 2 is a circuit diagram showing a pixel circuit of FIG. 1.

FIG. 2 is a circuit diagram showing the pixel 60 circuit of FIG. 1. The circuit diagram shown in FIG. 2 is an exemplary circuit diagram of a pixel (PXiij) 60 at a point where the i-th pixel row and the j-th pixel column meet among a plurality of pixels constructing the display unit 10 constructed in a matrix with n pixel rows and m pixel columns.

Referring to FIG. 2, the pixel(PXiij) 60 is connected to i-th scan line, the i-th light emission control line EMi and the j-th data line Dj, and includes an organic light emitting diode (OLED), a driving transistor M1, a capacitor Cst, a switching transistor M2 and a light emission control transistor M3.

The driving transistor M1 includes a gate connected to the switching transistor M2, one end connected to the first voltage ELVDD, i.e., driving voltage, source, and the other end connected to an anode electrode of the OLED. In further detail, the other end of the driving transistor M1 is connected to one end of the light emission control transistor M3 and connected to the OLED through the light emission control transistor M3 as well. The driving transistor M1 delivers driving current (Ioled) of which the scale is different depending on the voltage across the gate and the other end to OLED.

The switching transistor M2 includes a gate connected to the scan line Si, one end connected to the data line Dj, and the other end connected to the gate of the driving transistor M1. The switching transistor M2 transmits data voltage depending on the corresponding image data signal Vdata[j] applied to the data line Dj to the gate of the driving transistor M1 when the switching transistor M2 is turned on in response to the scan signal scan[i] applied to the scan line Si.

The capacitor Cst includes one electrode connected to the gate of the driving transistor M1 and the other electrode connected to the first voltage ELVDD source. The data voltage transmitted to the gate of the driving transistor M1 is applied to the one electrode of the capacitor Cst through the switching transistor M2, and the first voltage ELVDD is applied to the other electrode thereof. Therefore, the value of a voltage as much as the difference in the voltage across both electrodes of the capacitor Cst is charged and is maintained after the switching transistor M2 is turned off.

The light emission control transistor M3 includes a gate connected to the light emitting signal line EMi, one end connected to the other end of the driving transistor M1, and the other end connected to the anode electrode of the OLED. The light emission control transistor M3 receives the light emission control signal EM[i] through the light emitting signal line EMi and is thus selectively turned on, such that the light emission control transistor M3 serves to supply current (Ioled) flowing across the driving transistor M1 to the OLED. According to the exemplary embodiment, the light emission control transistor M3 is controlled to be turned on/off depending on the predetermined light emission control signals established to have a duty width in an off duty width calculated according to the algorithm of ACL scheme to correspond to the output image data signals applied to the PenTile scheme. Therefore, the light emitting time for displaying images in the OLED is adjusted.

The OLED includes an anode electrode connected to the other end of the light emission control transistor M3, and a cathode electrode connected to the second voltage ELVSS source. The OLED emits light at an intensity different depending on the driving current (Ioled) corresponding to the data signal Vdata[j] supplied by the driving transistor M1 through the light emission control transistor M3, in order to display images.

The OLED may emit light in one color among the basic primary colors. Exemplary basic colors may include three primary colors of red, green and blue, and a desired color may be displayed according to a spatial sum or a temporal sum of these three primary colors. The display device according to the exemplary embodiment is a display device in the PenTile structure in which one pixel displays a spatial sum of the basic primary colors of red, first green, blue, and second green. Therefore, the pixel structure shown in FIG. 2 illustrates the circuit structure of a subpixel displaying one among, for example, two, three, four, or more basic primary colors.

The driving transistor M1, the switching transistor M2 and the light emission control transistor M3 may be a p-channel field effect transistor (FET). However, the driving transistor M1, the switching transistor M2 and the light emission control transistor M3 are not limited thereto, and at least one of M1, M2 and M3 may be an n-channel field effect transistor. Connection among the transistors M1, M2, and M3, the capacitor Cst and the OLED may be varied, provided that the circuit element can carry out the same role. The pixel 60 shown in FIG. 2 is an exemplary pixel of the display device, and a different type of pixel including at least two transistors or at least one capacitor may be used.

Figure 3:
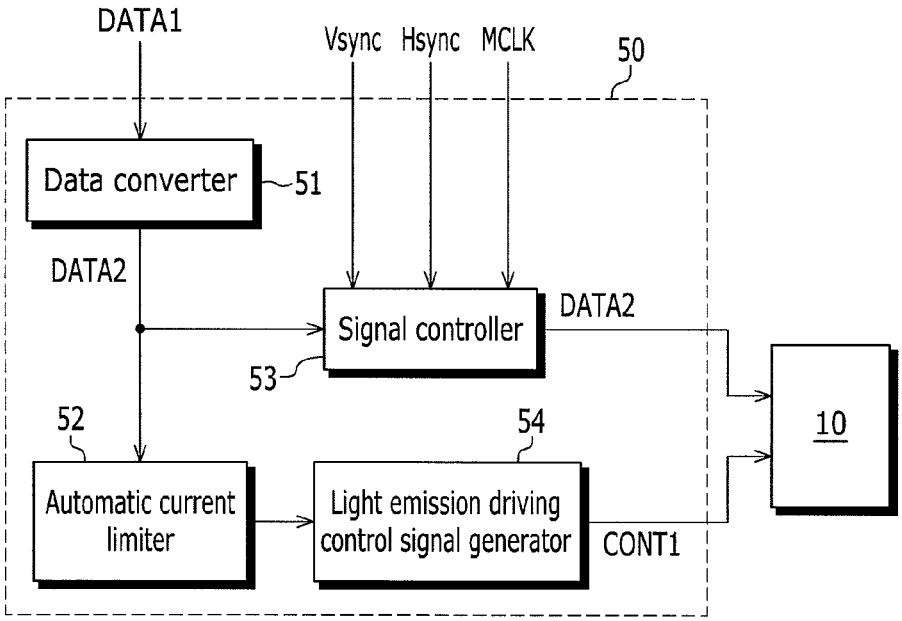
FIG. 3 is a block diagram showing in detail the configuration of a controller shown in FIG. 1 according to an exemplary embodiment.
Figure 4:
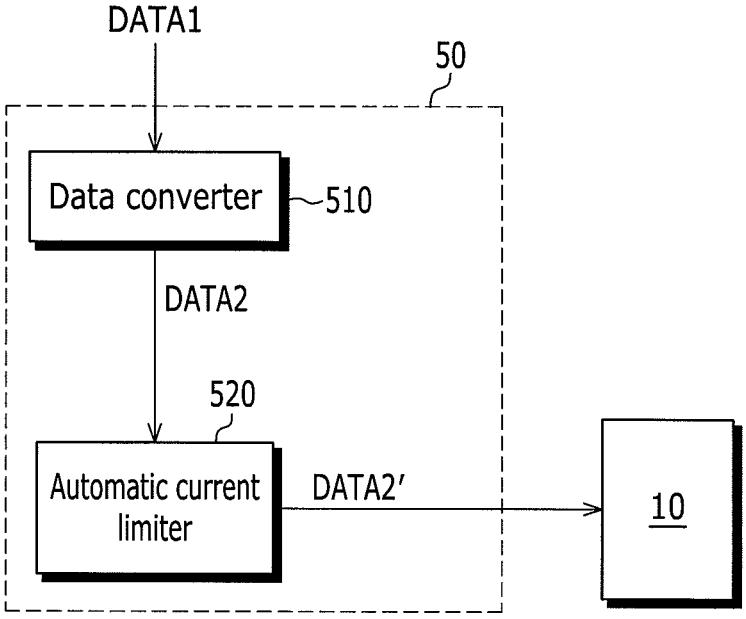
FIG. 4 is a block diagram showing in detail the configuration of the controller shown in FIG. 1 according to another exemplary embodiment.

FIG. 3 and FIG. 4 are block diagrams showing in detail an exemplary configuration of the controller 50 shown in FIG. 1 according to an exemplary embodiment.

That is, FIG. 3 shows a configuration of the controller 50 to carry out the ACL scheme appropriately applied to the PenTile structure of the display, provided that the ACL scheme is to adjust the off duty ratio of the light emission control signals.

First, referring to FIG. 3, the controller 50 includes the data converter 51 which receives the initial external image data signals DATA1 which are RGB signals to convert the signals to the image data signals DATA2 corresponding to the PenTile type in which the pixel structure in the display unit is an RGBG structure. Since the ACL scheme according to the exemplary embodiment of FIG. 3 is to adjust the off duty width of the light emission control signals, the controller 50 of FIG. 3 includes the automatic current limiter 52 for carrying out calculation with the ACL algorithm to be appropriate for the PenTile technology.

Although not shown in FIG. 3, the automatic current limiter 52 includes a structure for receiving the image data signals DATA2 converted in the data converter and calculating the pixel on ratio of a pixel, a first operation unit structure for executing an algorithm for calculating the off duty ratio of the light emission control signals to correspond to the pixel on ratio, and a second operation unit configured to develop luminance equations, calculate the compensated luminance value from the luminance data of summed image data to correspond to a luminance equation selected on the basis of pixel on ratio for each subpixel, and compensate for the image data signals DATA2. The structure for calculating the pixel on ratio is not included in the automatic current limiter 52 as shown in FIG. 3, but may be disposed as an independent constituent element belonging to the controller 50 according to another exemplary embodiment.

The image data signals converted in the data converter 51 are modulated so that the RGB signals can be appropriate for the PenTile structure, and the pixel on ratio (POR) of a pixel is found with reference to the data signals modulated in the structure for calculating the pixel on ratio of the pixel in the automatic current limiter 52.

The pixel on ratio of the pixel is found, by finding and summing up the pixel on ratio depending on the image data signals for each subpixel displaying the basic primary colors per frame.

The pixel on ratio for each subpixel is a ratio of the number of subpixels activated in a turned-on state to the entire number of subpixels displaying the basic primary colors, respectively, in one frame. That is, it is possible to decide on/off for each subpixel for each basic primary color in the structure for calculating pixel on ratio according to a digital signal to find the pixel on ratio for each subpixel. For example, since the converted image data signals DATA2 are the RG1BG2 signals applied to the PenTile structure, it is possible to find the pixel on ratio (PORr) for the red (R) signals, the pixel on ratio (PORg1) for the first green (G1) signals, the pixel on ratio (PORb) for blue (B) signals, and the pixel on ratio (PORg2) for the second green (G2) signals, respectively. The pixel on ratio (PORr) for the red (R) signals is a ratio for the number of subpixels for displaying red signals activated and turned on to the entire number of subpixels displaying the red signals per frame. The same concept is applied to the pixel on ratios for the remaining basic primary color signals.

Thereafter, the pixel on ratio for each subpixel is summed up to find the pixel on ratio of the entire pixels per frame. In this case, the pixel on ratio of the subpixel displaying green is the average of the pixel on ratio of the subpixel displaying the first green and the pixel on ratio of the subpixel displaying the second green. This can be expressed as the following Equation 1.

$$POR = POR_r + POR_b + (POR_{g1} + POR_{g2})/2, \quad \text{(Equation 1)}$$

wherein

POR: pixel on ratio of the entire pixels

PORr: pixel on ratio for the red (R) signals

PORb: pixel on ratio for the blue (B) signals

PORg1: pixel on ratio for the first green (G1) signals

PORg2: pixel on ratio for the second green (G2) signals

In general, since it is not necessary to apply ACL technology in order to reduce power consumption if image display is in a low luminance domain, the case of calculating the pixel on ratio (POR) of a pixel as described above for this embodiment will be limited to the case that image brightness is implemented above a reference level of luminance (ACL_START_STEP) to which a predetermined ACL scheme is applied.

That is, the pixel on ratio for the entire pixels found as described above is a pixel on ratio corresponding to the grayscale data level of image data actually input to the display device. Therefore, assuming the grayscale data level of the image data currently input is N, the level N is between the maximum grayscale data level (for example, maximum grayscale level 255) and the reference grayscale data level (ACL_START_STEP) at which ACL technology begins to be applied. That is, if the gray level (N) of the image data currently input is lower than the reference grayscale data level (ACL_START_STEP) to result in low luminance, it may not be necessary to apply the ACL technology for reducing power consumption and light emission control may not be carried out.

Following calculation of the pixel on ratio of the pixel in the automatic current limiter 52, the off pulse width of the light emission control signals is calculated on the basis of the calculation. It is possible to find the off pulse width (ACWE) of the light emission control signals with the following Equation 2, but calculation thereof is not necessarily limited thereto, and any algorithm may be applicable, provided that the pulse width of the light emission control signals is calculated to correspond to the pixel on ratio.

$$ACWE = ACWE_0 + (ACWE_MAX*2)*\{(POR_n_ACL_START_STEP)/(255_ACL_STARTSTEP)\} \quad \text{(Equation 2)}$$

ACWE: off pulse width of a light emission control signal in which the current pixel on ratio is reflected ACWE_0: predetermined off pulse width default value of light emission control signals depending on the specification of a display device ACWE_MAX: maximum predetermined value of the off pulse width of light emission control signals n_ACL_START_STEP: luminance value of the current image corresponding to the pixel on ratio calculated depending on the image data signals currently input 255_ACL_START_STEP: entire luminance value of the image (for example, 255 luminance values)

ACWE of the light emission control signals calculated with the algorithm, for example, Equation 2, may reflect the ratio in which the pixels are activated in implementing currently input images, to control the off duty and control brightness. That is, as the pixel on ratio (POR) of the display unit displaying the currently input images increases, the luminance value of the actual image by light emission rises as compared to the entire luminance value, so that ACWE of the light emission control signals increases. As a result, the period of light emission by the OLED and the amount of light emission is reduced to contribute to power consumption.

The controller 50 in FIG. 3 includes a signal controller 53 and a light emission driving control signal generator 54 in addition to the data converter 51 and the automatic current limiter 52.

The signal controller 53 controls images of the display unit 10, and receives image data signals, vertical synchronization signals Hsync, horizontal synchronization signals Vsync and main clock signals MLCK to control the images to be implemented in the display unit 10.

The light emission driving control signal generator 54 receives the off duty ratio (off pulse width) of the light emission control signals corresponding to the pixel on ratio of the pixel calculated in the automatic current limiter 52, generates and transmits the light emission driving control signals CONT1 for controlling the light emission driver to the light emission driver thus to control light emission of the display unit 10.

The light emission driving control signal generator 54 in FIG. 3 is a signal generator which generates and transmits light emission driving control signals, generates and transmits various control signals transmitted to a driving IC circuit, for example, scan driving control signals, data driving control signals, etc., as well.

In various exemplary embodiments, the controller 50 of the display unit includes the signal controller 53 for controlling image display, and the light emission driving control signal generator 54 for generating and transmitting a plurality of driving control signals. Therefore, although not shown in FIG. 4, the controller 50 of FIG. 4 as another embodiment may include the aforementioned signal controller and the driving control signal generator.

That is, the configuration of the controller 50 shown in FIG. 4 is a configuration for modulating image data signals for reducing luminance as an ACL scheme appropriately applied to the PenTile structure. Although not shown in FIG. 4, it is natural that the controller 50 of FIG. 4 includes a signal controller and a driving control signal generator. Referring to FIG. 4, the controller 50 includes a data converter 510 and an automatic current limiter 520.

The data converter 510 of FIG. 4 receives initial external image data signals DATA1 that are the RGB signals, as in FIG. 3, and converts the signals to image data signals DATA2 corresponding to the pixel structure of the display unit. If the display unit 10 of the display device is in the PenTile structure having the subpixel arrangement type of RGBG, the image data signals DATA2 are the signals modulated from RGB signals to the RG1/BG2 signals which are image data signals applicable to the PenTile structure.

The automatic current limiter 520 of FIG. 4 reduces luminance in a manner of re-compensating for and outputting image data signals, unlike the ACL scheme according to the exemplary embodiment of FIG. 3. That is, the automatic current limiter 520 receives the image data signals DATA2 converted in the data converter 510, selects a reference value for compensating for data on the basis of the pixel on ratio of the pixel of the display unit corresponding to the image data signals currently input, re-compensates for the image data signals DATA2 to output the compensated image data signals DATA2'. Particularly, an ACL algorithm which can be integrated with the data rendering technology is provided because the pixel on ratios for each subpixel implementing basic primary colors of a pixel are calculated and compared to determine the compensated reference value for the input image data signals.

Therefore, the automatic current limiter 520 of FIG. 4 may include a structure for calculating the pixel on ratio of pixel, particularly the pixel on ratio for each subpixel as in FIG. 3, or the structure may be included in the controller 50, independently of the automatic current limiter 520.

Specifically, the detailed configuration of the automatic current limiter 520 of FIG. 4 will be described with reference to the detailed block diagram shown in FIG. 5. The automatic current limiter 520 of FIG. 5 consists of a luminance calculation development unit 521, a luminance data summation unit 522, and a data compensator 523. The luminance calculation development unit 521 receives the image data signals DATA2 converted in the data converter 510 and develops calculation of luminance Y and Y' on the basis of the input data. The luminance values are calculated according to coefficient calculation selected by a user as in the following example of Equation 3.

$$Y=Kr1Yr+Kg1Yg+Kb1Yg+Kg2Yg,$$

$$Y'=bKr1Yr+bKg1Yg+bKb1Yb+bKg2Yg \quad \text{(Equation 3)}$$

In this case, Kr1, Kg1, Kb1, Kg2, bKr1, bKg1, bKb1 and bKg2 are coefficients depending on OLED material characteristics, and Yr, Yg and Yb are basic primary color R, G, B signal data of the image data signals DATA2, respectively.

The luminance Y is an equation developed for compensating for ordinary luminance, and the luminance Y' is an equation developed for automatically limiting current depending on the material characteristics of OLED. Therefore, depending on exemplary embodiments, diversified equations for the luminance Y' may further be developed in the luminance calculation development unit 521.

Equation 3 is for an exemplary embodiment, and implementations are not limited thereto, and any equation capable of calculating a luminance value depending on the image data signals DATA2 may be used. For example, a weighted data equation may be used.

The luminance data summation unit 522 determines which will be applied between the luminance Y and Y' developed in the luminance calculation development unit 521 to add image data and thus to find luminance data. The luminance data summation unit 522 adds entire luminance data (Ytot) per frame, and calculates the average (Yavg) thereof to determine resulting compensated luminance (ΔY). When the ACL technology is applied to the PenTile structure, the compensated luminance (ΔY) is determined on the basis of the pixel on ratio for each of R, G and B subpixels calculated in the structure for calculating the pixel on ratio of pixel (not shown). For example, calculation of luminance Y or luminance Y' is selected according to the resulting decision following comparison of Pixel On Ratio of the blue (B) signal (PORb) with the Pixel On Ratio of other basic color signals.

In the example of Equation 3, since the luminance Y' reflects the coefficient b depending on the OLED material characteristics in the Equation 3 as compared to the luminance Y, it is determined to sum up the image data with the equation of luminance Y' if the pixel on ratio (PORb) of the blue (B) signal is greater than that of the other primary color signals, that is, the pixel on ratio (PORr) of the red (R) signal or the pixel on ratio ((PORg1+PORg2)/2) of the green (G) signal.

If the pixel on ratio (PORb) of the blue (B) signal is smaller than or equal to the pixel on ratio of the other primary color signals, it is determined to sum up image data with the equation of luminance Y. That is, the greater pixel on ratio (PORb) for the blue (B) signal per frame than pixel on ratios of other primary colors implies that displayed image is relatively dark as compared to the case otherwise. Therefore, the characteristics for the subpixels to output the blue signals must be taken into account in compensating for luminance of input image data. Therefore, it is possible to determine summation of image data with the equation of the luminance Y'.

The luminance data summation unit 522 sums up image data with the determined luminance Y or Y' to find luminance data, and calculates the average luminance data (Yavg) of the entire display unit per frame. In general, a look-up table is stored in the driving IC circuit, in which luminance values (ΔY) compensated depending on luminance values are calculated. It is possible to determine compensated luminance values (ΔY) depending on the average luminance data (Yavg) calculated in the luminance data summation unit 522 with the look-up table. The compensated luminance value (ΔY) is greater if the pixel on ratio (PORb) of the blue (B) signal per frame is greater than the pixel on ratio of the other primary colors.

The look-up table for calculating the compensated luminance values (ΔY) may be generally stored in a memory of a driving IC, and may be stored in the manner of multiple time program ROM (MTP) which can be erased and written multiple times or one time program ROM (OTP) which can be erased and written only once.

The data compensator 523 finds compensated data signals, each corresponding to red, blue, first green and second green signals of the image data signals DATA2 with the compensated luminance values (ΔY) determined in the luminance data summation unit 522.

That is, since the pixel structure of the display unit according to the exemplary embodiment is the PenTile structure, it is possible to find compensated data signals for each of the basic primary color data signal of the image data signals DATA2 converted to correspond to the structure. For example, if the luminance range is 256 grayscales, the equation for compensating for the basic primary color data signals of the image data signals DATA2 with the compensated luminance values (ΔY) is the following Equation 4.

$$R'=R(1-(\Delta Y/256))$$

$$G1'=G1(1-(\Delta Y/256))$$

$$B'=B(1-(\Delta Y/256))$$

$$G2'=G2(1-(\Delta Y/256)) \quad \text{(Equation 4)}$$

Since Equation 4 is an exemplary compensation equation of data signals with the compensated luminance values (ΔY), it is natural that the equation for compensating for the basic primary color data signals is not limited thereto.

The data compensator 523 compensates for the image data signals DATA2 of the RG1BG2 signals with compensated luminance values for which the pixel on ratio of subpixels is considered according to Equation 4, to output compensated image data signals DATA2, for example, R'G1'B'G2' signals.

If the pixel on ratio (PORb) for the blue (B) signal per frame is greater than the pixel on ratios of the other primary colors, the compensated luminance value (ΔY) is greater, so that the data values of the basic primary colors of each compensated image data signal DATA2' are compensated to be small. Therefore, the effect in which luminance is reduced in the image output with the compensated image data signals DATA2' may be expected.

Figure 5:
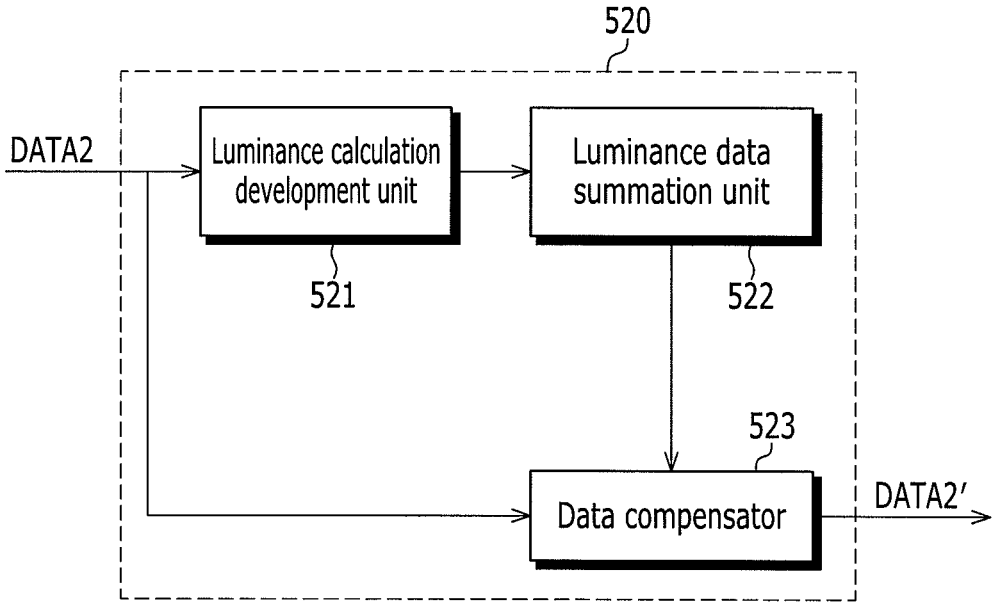
FIG. 5 is a block diagram showing the specific configuration of an automatic current limiter of FIG. 4.
Figure 8:
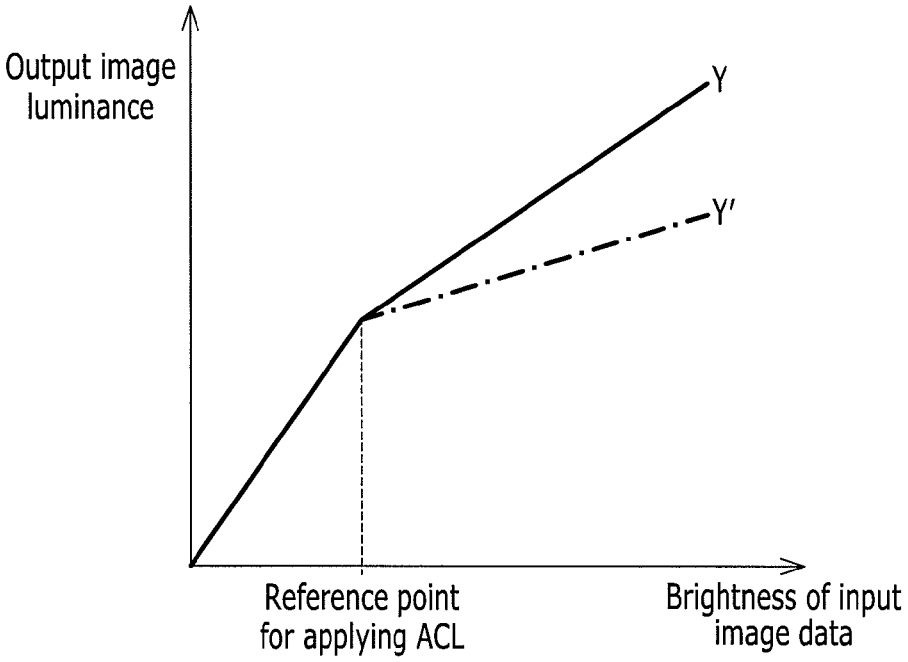
FIG. 8 is a graph showing the effect of reducing luminance by use of the method of automatically limiting current in a display device according to an exemplary embodiment.

FIG. 8 is a graph in which luminance is reduced when image data signals are adjusted, to which the ACL scheme is applied with the automatic current limiter 520, as described in FIG. 4 and FIG. 5. FIG. 8 is a graph showing luminance (vertical axis) of output images with respect to input image data brightness (horizontal axis). Since it is unnecessary to adjust image data signals input by applying the ACL scheme in a low luminance domain, the adjustment is carried out at the brightness above a predetermined reference point for applying the ACL scheme.

Referring to FIG. 8, line Y denotes extraction of compensation values for luminance data and resulting compensation of input data with an ordinary equation Y. Line Y' denotes extraction of compensation values for luminance data depending on the equation (Y') developed considering the case where ratios accounted by the pixel on ratio (PORb) of the blue (B) signal per frame is great and resulting compensation of input data.

Therefore, since the luminance of the final output image is reduced because the line Y' is lower than the line Y, overall power consumption is advantageously reduced as a result. To say it again, the line Y exhibits an increase in power consumption and a reduction in life span, which is a disadvantage, due to bright image output because of high dependence on the red (R) signal or the green (G) signal. On the contrary, the line Y' exhibits reduced power consumption to result in long product life spans because of high dependence on the blue (B) signal.

That is, if the line Y' is applied, it is the case of a frame with more blue (B) signals. Although the same power is actually applied, the image looks dark because of low luminance (brightness) of blue. Therefore, Y', not Y, is introduced because of small perceived loss although ACL technology is applied more to a screen of frames with more blue (B) signals.

Figure 6:
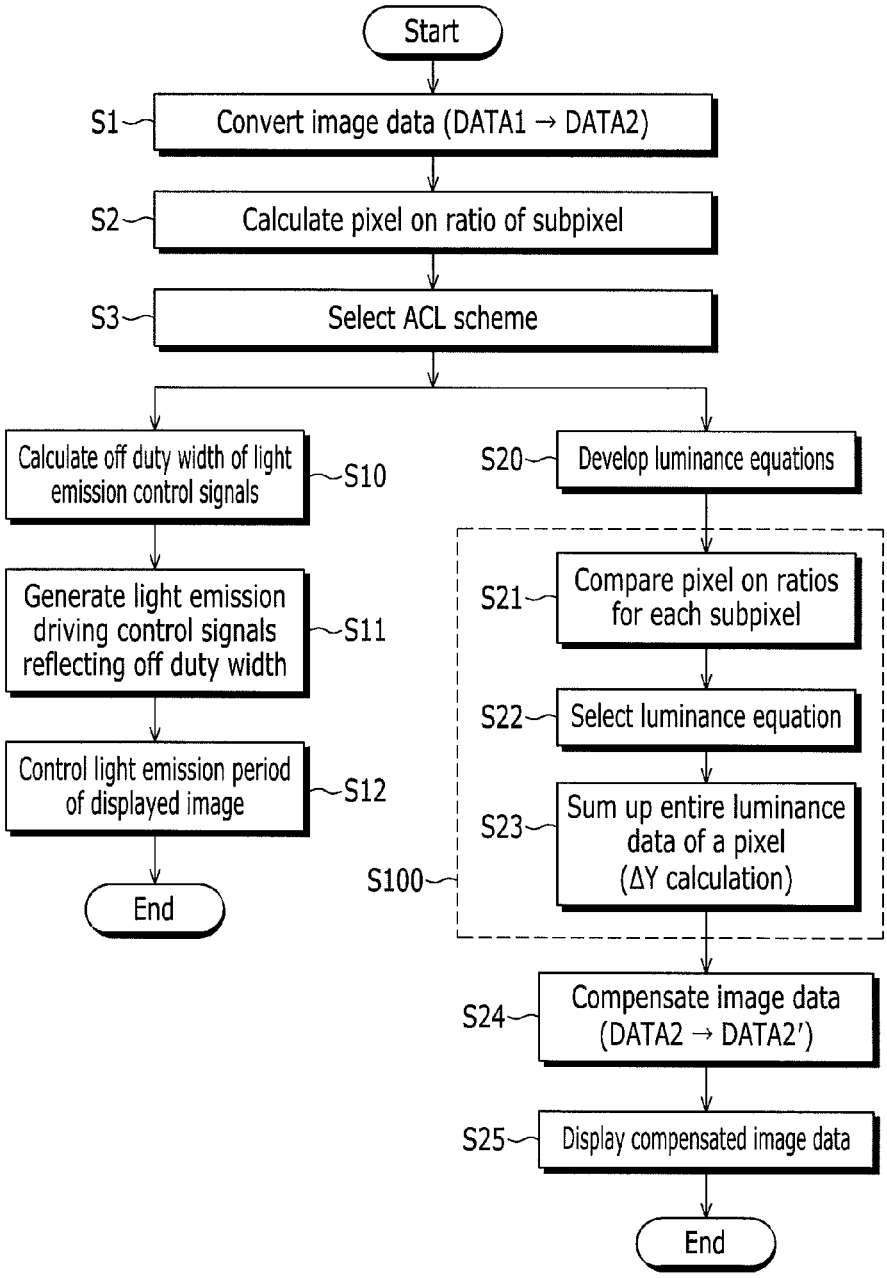
FIG. 6 is a flow chart showing a method of automatically limiting current of a display device according to an exemplary embodiment.
Figure 7:
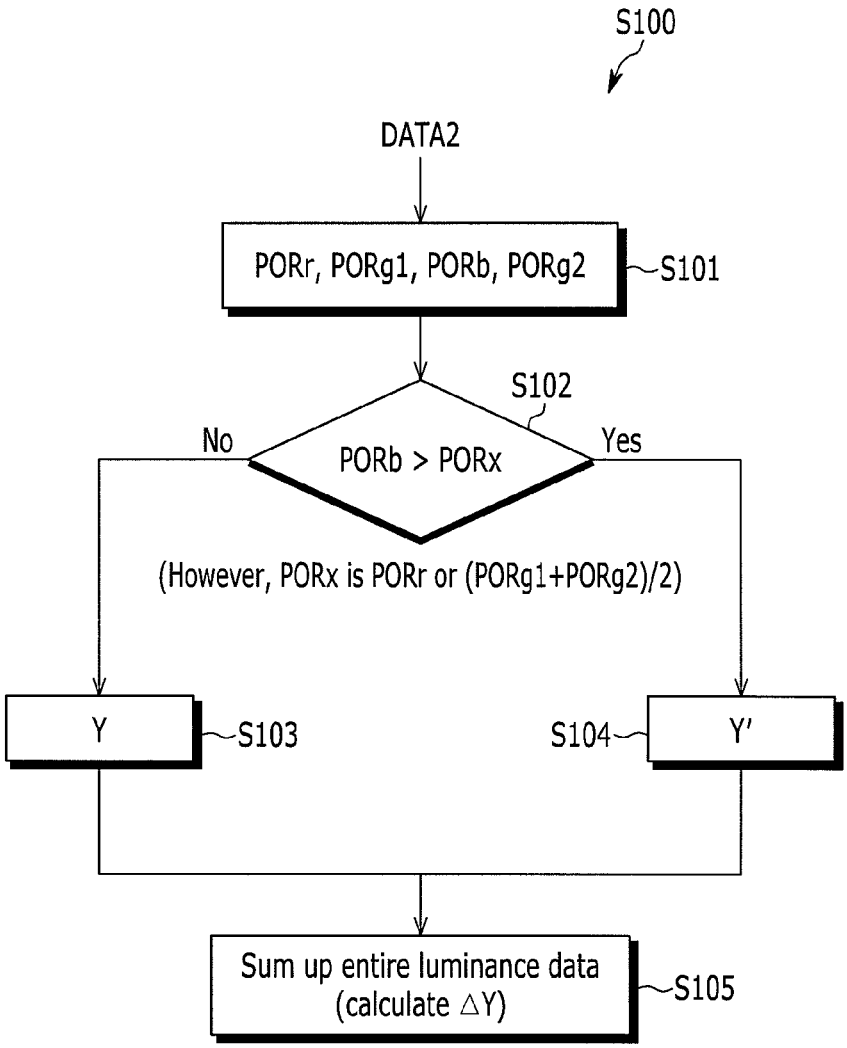
FIG. 7 is a flowchart showing in detail the process at S100 of FIG. 6 according to an exemplary embodiment.

FIG. 6 and FIG. 7 illustrate the process of automatically calculating current in a display device according to an exemplary embodiment. The process of S10 to S12 in FIG. 6 illustrates the ACL scheme of the display device according to the exemplary embodiment described with reference to FIG. 3. The process of S20 to S25 illustrates the ACL scheme of the display device according to another exemplary embodiment described with reference to FIG. 4 and FIG. 5.

FIG. 7 illustrates the process of S100 of FIG. 6 according to the exemplary embodiment 2 in more detail. Referring to FIG. 6, the controller 50 of the display device receives image data signals DATA1 from the outside and converts them to image data signals DATA2 to be applied to the RGB data rendering technology (S1).

The pixel on ratio for each subpixel displaying basic primary colors per frame is calculated (S2). In this case, the pixel on ratio of the entire pixels can be found as well. According to the exemplary embodiment, the display unit may be in the PenTile structure. Therefore, it is possible to calculate the pixel on ratio for each subpixel displaying images depending on red, first green, blue, and second green signals. In this case, the pixel on ratio may be collected as digital signal data depending on subpixel on/off and calculated.

Subsequently, it is selected which scheme of ACL technology according to the exemplary embodiment is applied (S3). That is, it is determined which to apply between the light emission period control followed by the process of S10 to S12, or data compensation followed by the process of S20 to S25.

In S3, it is possible to determine, in advance, the time at which the ACL scheme according to the exemplary embodiment is applied on the basis of the pixel on ratio calculated in S2. That is, it is not necessary to apply the ACL scheme in a low grayscale domain not higher than a predetermined brightness because driving current corresponding to the low grayscale domain is relatively low. Therefore, the ACL scheme is selected and applied, provided that a reference point for applying ACL is predetermined to compare the grayscale depending on the image data signals with the reference point for applying ACL, and the result is above the reference point for applying ACL.

When carrying out ACL through light emission period control according to the exemplary embodiment 1, the off duty width of the light emission control signals is calculated on the basis of the pixel on ratio of the pixel calculated in S2 (S10). The equation for calculating the off duty width of the light emission control signals will not be described because it was provided in Equation 2.

The information about the off duty width (off duty ratio) of the light emission control signals calculated in S10 is reflected in the light emission driving control signals generated in the light emission driving control signal generator 54 of the controller 50. That is, the light emission driving control signal generator 54 of the controller 50 generates light emission driving control signals including the information about the off duty ratio calculated by reflecting the pixel on ratio of the pixel (S11).

The light emission driving control signals are transmitted from the controller 50 to the light emission control driver 40. Each of the plurality of pixels included in the display unit 10 receives light emission control signals of which the off duty ratio is predetermined depending on the light emission driving control signals, and then emits light. The light emission period is controlled to correspond to the pixel on ratio of the pixel (S12). That is, as the pixel on ratio of the pixel increases, luminance (brightness) of the displayed images will increase. As a result, the off duty width of the light emission control signals is controlled to be set great. Accordingly, the light emission period is reduced and luminance is reduced thus to reduce power consumption.

When carrying out ACL through compensation of data signals according to the exemplary embodiment 2, a luminance equation is developed (S20). That is, it is possible to develop a luminance equation, which includes a coefficient corresponding to dependence on the basic primary color signals of subpixels displaying each of basic primary colors, and corresponding to the material characteristics of the OLED. The luminance equation is not limited to any specific equation, but was exemplified in the aforementioned Equation 3 as an equation including the coefficient reflecting material characteristics of a pixel. When selectively applying the luminance equation depending on the pixel on ratio for each subpixel, driving current may be automatically limited because data signals are calculated for compensating for reduced luminance of the image data signals. The process of S100 for calculating luminance-reduced compensated image data signals from the image data signals will hereinafter be described with reference to the flow chart of FIG. 7.

Following development of a luminance equation, the calculated pixel on ratio for each subpixel calculated in S2 is compared (S21). For example, as described with reference to FIG. 5, the pixel on ratios of the subpixels displaying the other basic color signals are compared on the basis of the pixel on ratio (PORb) of the blue subpixel displaying blue (B) signal.

Specifically referring to FIG. 7, pixel on ratios (PORr, PORg1, PORb, PORg2) for the subpixels displaying each basic primary color calculated in image data signals DATA2 converted to be applied to the PenTile structure, are acquired (S101).

The pixel on ratio (PORb) of the blue subpixel is compared with the pixel on ratio (PORx) of subpixels displaying the other basic color signals (S102). In this case, the pixel on ratio (PORx) of the subpixels displaying the other primary color signals is the pixel on ratio (PORr) of the subpixel displaying the red (R) signals or the pixel on ratio ((PORg1+PORg2)/2) of the subpixel displaying the green (G) signals.

The luminance equation Y is used if the pixel on ratio (PORb) of the blue subpixel is smaller than or equal to the pixel on ratio (PORx) of subpixels displaying the other primary color signals (S103). The luminance equation Y' is used if the pixel on ratio (PORb) of the blue subpixel is greater the pixel on ratio (PORx) of subpixels displaying the other primary color signals (S104). As illustrated in Equation 3, the luminance equation Y' includes the coefficient b in order to improve dependence on the blue signal as compared to the luminance equation Y.

As described above, following determination of the luminance equation on the basis of the pixel on ratio (PORb) of the blue subpixel, image data signals are summed up according to the luminance equation to obtain luminance data (S105). The luminance data for one frame is summed up to calculate the average value and to obtain the compensated luminance values (ΔY) depending on the average luminance data through the look-up table. With the compensated luminance values (ΔY) calculated through the process of S100, each basic primary color data signal of the image data signals DATA2 is compensated and output in S24 of FIG. 6. As described above, the image data signals DATA2' compensated in the controller 50 are output and transmitted to the data driver, to display images at a luminance compensated with a corresponding data voltage (S25).

In the exemplary embodiment shown in FIG. 6, different application of ACL schemes in the display device was described, respectively, but the present invention is not limited thereto, and both of ACL schemes in the exemplary embodiments 1 and 2 may be applied. That is, both of the methods may be simultaneously applied, one of which is to find the pixel on ratio for each subpixel displaying basic primary colors to correspond to the PenTile structure, followed by finding the off pulse width of the light emission control signals on the basis of the pixel on ratio to control the light emission period and the duration of light emission, and the other of which is to compare the pixel on ratio for each subpixel to select an appropriate luminance equation, followed by finding a compensated luminance value to compensate for image data signals.

The drawings and the detailed description described above are examples and are provided to explain various aspects, and the scope of the present invention is not limited thereto. Therefore, it will be appreciated to those skilled in the art that various modifications are made and other equivalent embodiments are available. Those skilled in the art can omit some of the constituent elements described in the present specification without deterioration in performance thereof or can add constituent elements to improve performance thereof. Further, those skilled in the art can modify the sequence of the steps of the method described in the present specification depending on the process environment or equipment.

What is claimed is:

1. A display device, comprising:

a display unit comprising a plurality of pixels connected to a plurality of scan lines, a plurality of light emission control lines, and a plurality of data lines, wherein each pixel is configured to emit light with a driving current corresponding to image data signals transmitted through the data lines during a light emission period based on light emission control signals transmitted through the light emission control lines, wherein each of the pixels comprises a plurality of subpixels, each configured to display one of a plurality of colors; and a controller configured to:

convert external video signals to image data signals, output the converted signals to a data driver, generate light emission driving control signals for controlling a light emission duty ratio of the light emission control signals, calculate a pixel on ratio for each subpixel to reduce the driving current for displaying images according to the pixel on ratio of the subpixel, and calculate an off duty width of the light emission control signals according to the pixel on ratio, wherein the light emission duty ratio corresponds to the off duty width of the light emission control signals.

2. The display device of claim 1, further comprising:

a scan driver configured to generate and transmit scan signals to the plurality of scan lines; and a light emission control driver configured to generate and transmit the light emission control signals to the plurality of light emission control lines, wherein the data driver is configured to receive the image data signals converted in the controller and transmit data voltages corresponding to the image data signals to the data lines.

3. The display device of claim 1, wherein the controller comprises:

a data converter configured to receive the external video signals and convert the external video signals to first image data signals for each of the subpixels according to each of the colors; and an automatic current limiter configured to calculate the pixel on ratio for each subpixel.

4. The display device of claim 3, wherein the automatic current limiter is configured to at least one of:

A) calculate the light emission duty ratio of the light emission control signals based on the pixel on ratio for each subpixel, B) compensate for the first image data signals to output second image data signals, with compensated luminance values calculated depending on the pixel on ratio for each subpixel, and C) calculate the light emission duty ratio of the light emission control signals on a basis of the pixel on ratio for each subpixel and compensate for the first image data signals to output second image data signals, with the compensated luminance values calculated depending on the pixel on ratio for each subpixel.

5. The display device of claim 4, wherein the automatic current limiter comprises:

a pixel on ratio calculator configured to calculate the pixel on ratio for each subpixel;

a first operation unit configured to calculate the light emission duty ratio of the light emission control signals; and a second operation unit configured to develop luminance equations, calculate the compensated luminance value from the luminance data of summed image data to correspond to a luminance equation selected on the basis of the pixel on ratio for each subpixel, and compensate for the first image data signals.

6. The display device of claim 5, wherein the first operation unit is configured to calculate the pixel on ratio of a pixel for each of a plurality of frames according to the pixel on ratio for each subpixel, and calculate the light emission off pulse width of the light emission control signals according to the pixel on ratio of the pixel.

7. The display device of claim 6, wherein:

the pixel on ratio for each subpixel is the pixel on ratio (PORr) for red(R) signals, the pixel on ratio (PORg1) for first green (G1) signals, the pixel on ratio (PORb) for blue(B) signals, and the pixel on ratio (PORg2) for second green (G2) signals, and the pixel on ratio (POR) of the pixel is calculated by means of PORr+PORb+(PORg1+PORg2)/2.

8. The display device of claim 6, wherein the off pulse width of the light emission control signals is calculated by summing up the off pulse width of the light emission control signals and the off pulse width adjusted to correspond to the pixel on ratio of the pixel from a predetermined maximum value of the off pulse width of the light emission control signals.

9. The display device of claim 5, wherein the second operation unit comprises:

a development unit configured to develop an equation for calculating luminance data;

a summation unit configured to:

compare the pixel on ratios for each subpixel to select one among the developed luminance equations, sum up image data depending on the selected equation to calculate a total luminance data and an average luminance data for each of a plurality of frames, and determine the corresponding compensated luminance values; and a compensator configured to compensate for the first image data signals with the compensated luminance values to output the second image data signals.

10. The display device of claim 9, wherein the luminance equation includes a coefficient reflecting material characteristics of an organic light emitting diode of the pixel.

11. The display device of claim 9, wherein comparison of the pixel on ratios for each subpixel is used to compare the scale of the pixel on ratio for the other color signals on the basis of the pixel on ratio (PORb) for the blue (B) signals.

12. The display device of claim 11, wherein the pixel on ratio for the other color signals is the pixel on ratio (PORr) for the red (R) signals or the average pixel on ratio ((PORg1+PORg2)/2) for the green (G1) signals.

13. The display device of claim 11, wherein the compensated luminance value is increased and the output image luminance of the image data signals compensated corresponding thereto is reduced if the pixel on ratio (PORb) for the blue (B) signals is greater than the pixel on ratios for the other color signals.

14. The display device of claim 1, wherein the controller is configured to reduce the driving current in the pixels on a basis of the pixel on ratio of the subpixel if a brightness of the displayed image corresponding to the external video signals is above a reference luminance value.

15. A method of driving a display device, the device including a display unit comprising a plurality of pixels emitting light with a driving current corresponding to image data signals during a light emission period depending on light emission control signals transmitted through a plurality of light emission control lines, wherein each of the pixels comprises a plurality of subpixels, the method comprising:

converting input video signals to first image data signals;

calculating a pixel on ratio for each subpixel displaying one of a plurality of colors according to the first image data signals transmitted in each of a plurality of frames; and reducing the driving current based on the pixel on ratio of the subpixels; and calculating an off duty width of the light emission control signals according to the pixel on ratio, wherein the light emission off duty ratio corresponds to the off duty width of the light emission control signals.

16. The driving method of a display device of claim 15, wherein:

the reducing of the driving current comprises:

calculating the pixel on ratio of a pixel in each frame according to the pixel on ratio for each subpixel, and calculating a light emission off pulse width of the light emission control signals according to the pixel on ratio of the pixel;

generating and transmitting light emission driving control signals representative of the calculated light emission off pulse width; and adjusting the off pulse width of the light emission control signals based on the light emission driving control signals, and controlling light emission in the display unit according to the light emission duty ratio of the light emission control signals.

17. The driving method of a display device of claim 16, wherein:

the pixel on ratio for each subpixel is the pixel on ratio (PORr) for red(R) signals, the pixel on ratio (PORg1) for first green (G1) signals, the pixel on ratio (PORb) for blue (B) signals, and the pixel on ratio (PORg2) for second green (G2) signals, and the pixel on ratio (POR) of the pixel is calculated by means of PORr+PORb+(PORg1+PORg2)/2.

18. The driving method of a display device of claim 16, wherein the off pulse width of the light emission control signals is calculated by summing up the off pulse width of the light emission control signals and an off pulse width adjusted to correspond to the pixel on ratio of the pixel from a predetermined maximum value of the off pulse width of the light emission control signals.

19. The driving method of a display device of claim 15, wherein the reducing of the driving current comprises:

developing a luminance equation for calculating luminance data;

comparing the pixel on ratios for each subpixel to select one among the developed luminance equations;

summing up image data according to the selected equation to calculate a total luminance data and an average luminance data for each frame, and determining corresponding compensated luminance values;

compensating for the first image data signals with the compensated luminance values to output second image data signals; and displaying images in the display unit depending on the second image data signals.

20. The driving method of a display device of claim 19, wherein the luminance equation includes a coefficient reflecting material characteristics of the organic light emitting diode of the pixel.

21. The driving method of a display device of claim 19, wherein the comparing of pixel on ratios for each pixel is used to compare the scale of pixel on ratio for the other color signals on the basis of the pixel on ratio (PORb) for the blue (B) signals.

22. The driving method of a display device of claim 21, wherein the pixel on ratio for the other color signals is the pixel on ratio (PORr) for the red (R) signals or the average pixel on ratio ((PORg1+PORg2)/2) for the green (G1) signals.

23. The driving method of a display device of claim 21, wherein the compensated luminance value is increased and the output image luminance of the image data signals compensated corresponding thereto is reduced, if the pixel on ratio (PORb) for the blue(B) signals is greater than the pixel on ratios for the other color signals.

24. The driving method of a display device of claim 15, wherein the reducing of the driving current comprises at least one of:

(a) calculating the pixel on ratio of a pixel for each frame according to the pixel on ratio for each subpixel, and calculating a light emission off pulse width of the light emission control signals according to the pixel on ratio of the pixel to control light emission of the display unit depending on the light emission duty ratio of the light emission control signals, and (b) comparing the pixel on ratios for each subpixel to select one of the luminance equations, summing up image data depending on the selected equation to calculate a total luminance data and an average luminance data for each frame, determining corresponding compensated luminance values, and compensating for the first image data signals with the compensated luminance values to output second image data signals for displaying images; and determining whether to perform (a) and (b) prior to reducing of the driving current.

25. The driving method of a display device of claim 15, wherein reducing the driving current is performed if a brightness of display image corresponding to the external video signals is above a reference luminance value.

26. A method of driving a display device, the device including a display unit comprising a plurality of pixels emitting light with a driving current corresponding to image data signals during a light emission period depending on light emission control signals transmitted through a plurality of light emission control lines, wherein each of the pixels comprises a plurality of subpixels, the method comprising:

converting input video signals to first image data signals;

calculating a pixel on ratio for each subpixel displaying one of a plurality of colors according to the first image data signals transmitted in each of a plurality of frames; and reducing the driving current based on the pixel on ratio of the subpixels, wherein the reducing of the driving current comprises:

calculating the pixel on ratio of a pixel in each frame according to the pixel on ratio for each subpixel, and calculating a light emission off pulse width of the light emission control signals according to the pixel on ratio of the pixel;

generating and transmitting light emission driving control signals reflecting the calculated light emission off pulse width; and adjusting the off pulse width of the light emission control signals based on the light emission driving control signals, and controlling light emission in the display unit according to the light emission duty ratio of the light emission control signals, wherein the pixel on ratio for each subpixel is the pixel on ratio (PORr) for red(R) signals, the pixel on ratio (PORg1) for first green (G1) signals, the pixel on ratio (PORb) for blue (B) signals, the pixel on ratio (PORg2) for second green (G2) signals, and the pixel on ratio (POR) of the pixel is calculated by means of PORr+PORb+(PORg1+PORg2)/2.

* * * * *